US009622297B2

(12) United States Patent
Tonomura et al.

(10) Patent No.: US 9,622,297 B2
(45) Date of Patent: Apr. 11, 2017

(54) METALLIC BODY INDUCTION HEATING APPARATUS

(71) Applicant: TOKUDEN CO., LTD., Kyoto-shi, Kyoto (JP)

(72) Inventors: Toru Tonomura, Kyoto (JE); Yasuhiro Fujimoto, Kyoto (JE)

(73) Assignee: TOKUDEN CO., LTD., Kyoto-shi (JP)

( * ) Notice: Subject to any disclaimer, the term of this patent is extended or adjusted under 35 U.S.C. 154(b) by 788 days.

(21) Appl. No.: 13/708,230

(22) Filed: Dec. 7, 2012

(65) Prior Publication Data

US 2013/0146589 A1 Jun. 13, 2013

(30) Foreign Application Priority Data

Dec. 9, 2011 (JP) ..... 2011-269901
Dec. 9, 2011 (JP) ..... 2011-269957

(51) Int. Cl.

| | |
|---|---|
| ***H05B 6/02*** | (2006.01) |
| ***H05B 6/10*** | (2006.01) |
| ***H01F 3/00*** | (2006.01) |
| ***H01F 38/00*** | (2006.01) |
| ***H05B 6/36*** | (2006.01) |

(52) U.S. Cl.
CPC ..... *H05B 6/36* (2013.01); *H05B 6/10* (2013.01)

(58) Field of Classification Search
CPC ..... H01F 1/10; H01F 1/12; H01F 3/00; H01F 7/00; H01F 27/00; H01F 29/00; H01F 30/00; H01F 38/00; H05B 6/02; H05B 6/101; H05B 6/10
USPC ..... 219/660–677; 336/165, 84, 87, 130, 336/131–136, 178
See application file for complete search history.

(56) References Cited

U.S. PATENT DOCUMENTS

| | | | | |
|---|---|---|---|---|
| 2,609,531 | A * | 9/1952 | Kirchner | 336/83 |
| 4,047,138 | A * | 9/1977 | Steigerwald | 336/100 |
| 4,281,234 | A | 7/1981 | Dohogne | |
| 4,344,126 | A * | 8/1982 | Schumacher | 363/126 |
| 4,459,576 | A * | 7/1984 | Fox et al. | 336/84 C |

(Continued)

FOREIGN PATENT DOCUMENTS

| | | |
|---|---|---|
| CN | 203027520 U | 6/2013 |
| JP | S57018292 U | 1/1982 |

(Continued)

OTHER PUBLICATIONS

State Intellectual Property Office of the People's Republic of China, Office Action Issued in Chinese Patent Application No. 201210515097.0, Jun. 24, 2015, 9 pages.

(Continued)

*Primary Examiner* — Michael Laflame, Jr.
(74) *Attorney, Agent, or Firm* — Alleman Hall McCoy Russell & Tuttle LLP

(57) ABSTRACT

The present invention is one that uniformly and simultaneously heats a plurality of cup-shaped or annular metallic bodies to improve productivity, and has a plurality of divided core parts formed by dividing an annular core; configured such that a plurality of divided end parts of the divided core part are respectively attached with metallic bodies W made of non-magnetic metal; and inductively heats the metallic bodies W through input windings provided in outer or inner circumferential parts of the metallic bodies W.

18 Claims, 13 Drawing Sheets

(56) References Cited

U.S. PATENT DOCUMENTS

| | | | | |
|---|---|---|---|---|
| 4,761,527 | A | 8/1988 | Mohr | |
| 4,943,793 | A * | 7/1990 | Ngo et al. | 336/83 |
| 5,481,238 | A * | 1/1996 | Carsten et al. | 336/214 |
| 5,656,983 | A * | 8/1997 | Ito et al. | 335/297 |
| 6,661,327 | B1 * | 12/2003 | Funk | 336/212 |
| 2002/0097127 | A1 * | 7/2002 | Fujiwara et al. | 336/178 |
| 2002/0101321 | A1 * | 8/2002 | Nishimizu et al. | 336/212 |
| 2004/0032315 | A1 * | 2/2004 | Illingworth | 336/212 |
| 2004/0085174 | A1 * | 5/2004 | Decristofaro et al. | 336/178 |
| 2005/0206487 | A1 * | 9/2005 | Honsberg-Riedl et al. | 336/178 |
| 2006/0044105 | A1 * | 3/2006 | Darmann et al. | 336/DIG. 001 |
| 2006/0186979 | A1 * | 8/2006 | Kawarai | 336/83 |
| 2011/0226757 | A1 | 9/2011 | David et al. | |
| 2011/0241815 | A1 * | 10/2011 | Lu | 336/198 |

FOREIGN PATENT DOCUMENTS

| | | | |
|---|---|---|---|
| JP | S57053090 | A | 3/1982 |
| JP | S63108151 | A | 5/1988 |
| JP | H03029289 | A | 2/1991 |
| JP | H06208887 | A | 7/1994 |
| JP | H07183079 | A | 7/1995 |
| JP | H09153393 | A | 6/1997 |
| JP | H10055881 | A | 2/1998 |
| JP | 2002181455 | A | 6/2002 |
| JP | 2002194447 | A | 7/2002 |
| JP | 2004278930 | A | 10/2004 |
| JP | 2010071624 | A | 4/2010 |
| JP | 2011023251 | A | 2/2011 |
| JP | 2011082387 | A | 4/2011 |
| TW | I303444 | B | 11/2008 |

OTHER PUBLICATIONS

Japanese Patent Office, Office Action Issued in Japanese Patent Application No. 2011-269901, Sep. 15, 2015, 6 pages.

Japanese Patent Office, Office Action Issued in Japanese Patent Application No. 2011-269957, Sep. 15, 2015, 6 pages.

* cited by examiner

METALLIC BODY INDUCTION HEATING APPARATUS

TECHNICAL FIELD

The present invention relates to a metallic body induction heating apparatus that heats a cup-shaped or annular non-magnetic metallic body by induction heating.

BACKGOUND ART

As an apparatus that inductively heats an annular metallic body serving as a heating target, as disclosed in Patent literature 1, there is an apparatus that inductively heats an annular metallic body by providing a plurality of annular cores along a circumferential direction of the annular metallic body, and applying an AC voltage to input windings to thereby apply short-circuit current to the annular metallic body.

Specifically, this induction heating apparatus is provided with: the plurality of annular cores that are provided along the circumferential direction of the annular metallic body serving as the heating target such that the annular metallic body penetrates through the cores; and the input windings that are respectively wound around parts of the annular cores and applied with the AC voltage.

However, the above-described induction heating apparatus has a problem that the plurality of annular cores are used for the one heating target and therefore productivity is poor.

Meanwhile, a cup-shaped metallic body formed in a bottom-equipped tubular-shape cannot be inductively heated by the above-described induction heating apparatus, and is therefore still heated with use of a heating furnace as disclosed in Patent literature 2.

However, a configuration in which the heating furnace is used to heat the cup-shaped metallic body has a problem in temperature rising efficiency such as a low temperature rising rate and a problem of poor thermal efficiency.

CITATION LIST

Patent Literature

[Patent literature 1] JPA 2011-23251
[Patent literature 2] JPA 2004-278930

SUMMARY OF INVENTION

Technical Problem

Therefore, the present invention is made in order to solve the above-described problems at once, and a main intended object thereof is to enable an annular or cup-shaped metallic body made of non-magnetic metal to be efficiently heated, and to simultaneously heat a plurality of cup-shaped metallic bodies with one induction heating apparatus to improve productivity.

Solution to Problem

Accordingly, an annular metallic body induction heating apparatus according to the present invention comprises a plurality of divided core parts formed by dividing an annular core; a plurality of divided end parts in at least one of the divided core parts, the plurality of divided end parts respectively attached with annular metallic bodies made of non-magnetic metal to thereby make the annular core penetrate through the annular metallic bodies; and input windings provided in respective outer circumferential parts or inner circumferential parts of the annular metallic bodies to inductively heat the plurality of annular metallic bodies by application of an AC voltage.

By attaching the annular metallic bodies to the divided end parts of the divided core parts and applying the AC voltage to the input windings, short-circuit currents flow in the annular metallic bodies made of non-magnetic metal to cause induction heat generation, and therefore the annular metallic bodies can be efficiently heated. Also, the plurality of divided end parts of the divided core parts are respectively attached with the annular metallic bodies, so that the annular metallic bodies can be inductively heated by the one annular core, and therefore the annular metallic bodies can be simultaneously heated to improve productivity.

In addition, if each of the annular metallic bodies is one made of magnetic metal, the metallic body itself forms a magnetic path and a short circuit to generate heat even if a configuration in which a magnetic path penetrates inside the metallic body is not necessarily made. On the other hand, just because each of the annular metallic bodies is made of non-magnetic metal, the present invention requires the configuration in which the core for forming a magnetic path is arranged on an inner circumferential side of the annular metallic body to make magnetic flux penetrate through the non-magnetic metal.

In order to divide the annular core into a plurality of parts on the basis of a simple configuration, the annular core is desirably configured to be a cut core type wound core.

A specific embodiment in the case where the annular core is configured to be the cut core type wound core is desirably configured such that the annular core is divided into a first divided core part and a second divided core part that comprise a cut core, and a plurality of divided end parts in at least one of the first divided core part and the second divided core part are respectively attached with the annular metallic bodies.

In order to divide the annular core into a plurality of parts on the basis of a simple configuration other than the cut core type wound core, desirably, the annular core is configured to include a plurality of leg cores, a first yoke core connected to one end parts of the plurality of leg cores, and a second yoke core connected to the other end parts of the plurality of leg cores; and each of the plurality of leg cores is formed in a cylindrical shape that is formed by radially stacking a number of magnetic steel sheets each having a curved part curved into an involute shape (hereinafter also referred to as an involute core).

A specific embodiment in the case where the annular core is configured to include the plurality of leg cores, the first yoke core, and the second yoke core, is desirably configured such that the annular core is divided into a first divided core part including the plurality of leg cores and the first yoke core; and a second divided core part including the second yoke core, and the plurality of leg cores are respectively attached with the annular metallic bodies. If so, structure including the leg cores and second yoke core that are arranged as separate members can be utilized to inductively heat the annular metallic bodies without performing processing such as dividing a leg core.

If a cross-sectional area of each of the leg cores is limited by a relationship with an inside diameter of each of the annular metallic bodies, by increasing a frequency of the AC voltage applied to the input windings, a magnetic flux density can be kept equal to or less than a saturation magnetic flux density with the required input voltage being ensured. However, this case causes a problem that the increase in frequency causes an increase in iron loss to increase temperature of the leg cores. In order to preferably solve the problem with use of the structure of the involute core, desirably, cooling pipes are provided in close contact with inner circumferential surfaces of the plurality of leg cores, and a cooling medium is circulated in the cooling pipes to thereby cool the plurality of leg cores.

In order to easily attach/detach the annular metallic bodies, the annular metallic body induction heating apparatus is desirably provided with an attachment/detachment mechanism that moves at least one divided core part of the plurality of divided core parts between an attachment position where the annular metallic bodies are attached and the plurality of divided core parts form a closed magnetic path and a detachment position where the annular metallic bodies can be detached from the divided end parts of the divided core parts.

Also, a cup-shaped metallic body induction heating apparatus according to the present invention comprises a plurality of divided core parts formed by dividing an annular core, wherein in a state where a plurality of divided end parts of the divided core parts are respectively covered with cup-shaped metallic bodies made of non-magnetic metal, the cup-shaped metallic bodies are sandwiched by the plurality of divided core parts; and input windings provided in outer circumferential parts or inner circumferential parts of the cup-shaped metallic bodies to inductively heat the cup-shaped metallic bodies by application of an AC voltage.

By sandwiching the cup-shaped metallic bodies made of non-magnetic metal by the plurality of divided core parts with covering the divided end parts of the divided core parts with the cup-shaped metallic bodies, and applying the AC voltage to the input windings, short-circuit currents flow in the cup-shaped metallic bodies to cause induction heat generation, and therefore the cup-shaped metallic bodies can be efficiently heated. Also, the plurality of divided end parts of the divided core parts are respectively covered with the cup-shaped metallic bodies, so that the plurality of cup-shaped metallic bodies can be inductively heated by the one annular core, and therefore the plurality of cup-shaped metallic bodies can be simultaneously heated to improve productivity.

In addition, if each of the cup-shaped metallic bodies is made of magnetic metal, the cup-shaped metallic body itself forms a magnetic path and a short circuit to generate heat even if a configuration in which a magnetic path penetrates inside the metallic body is not necessarily made. On the other hand, just because each of the cup-shaped metallic bodies is made of non-magnetic metal, the present invention requires the configuration in which the core for forming a magnetic path is arranged on an inner circumferential side of the cup-shaped metallic body to make magnetic flux penetrate through the non-magnetic metal.

Further, if between the pairs of divided end parts corresponding to each other in the divided core parts (closed magnetic path core), the cup-shaped metallic bodies serving as heating targets are sandwiched, a core length is increased correspondingly to a thickness of each of the cup-shaped metallic bodies. If there are a plurality of pairs of divided end parts facing to each other, and between one of the pairs, a heating target is sandwiched, by elongating at least one of the other pair of divided end parts by a thickness of the heating target, the other pair of divided end parts can be brought into close contact with each other even in a state where the heating target is sandwiched. This configuration has no problem if the heating target constantly has the same shape; however, in the case of sandwiching a heating target having a different thickness, a mechanism that adjusts a length (core length) of a pair of divided end parts is necessary. Accordingly, by sandwiching the same heating targets between all of the plurality of pairs, the mechanism that adjusts the length (core length) of the divided end parts becomes unnecessary, and the plurality of heating targets can be heated at once. Even in the case where a thickness of each of the heating targets is different each time, if the heating targets to be heated each time are the same, this can apply.

A specific embodiment in the case where the annular core is configured to be a cut core type wound core is desirably configured such that the annular core is divided into a first divided core part and a second divided core part that comprise a cut core, and in a state where a plurality of divided end parts in at least one of the first divided core part and the second divided core part are covered with the cup-shaped metallic bodies, the cup-shaped metallic bodies are sandwiched by the first divided core part and the second divided core part.

In this case, if the cup-shaped metallic body heating apparatus is configured to, in a state where a plurality of divided end parts in both of the first divided core part and the second divided core part are covered with the cup-shaped metallic bodies, sandwich the cup-shaped metallic bodies by the first and second divided core parts, the number of cup-shaped metallic bodies that can be simultaneously heated can be increased to further improve productivity of the cup-shaped metallic bodies.

A specific embodiment in the case where the annular core is configured to include a plurality of leg cores, a first yoke core, and a second yoke core is desirably configured such that the annular core is divided into: a first divided core part including the plurality of leg cores and the first yoke core; and a second divided core part including the second yoke core, and in a state where the other end parts of the plurality of leg cores are covered with the cup-shaped metallic bodies, the cup-shaped metallic bodies are sandwiched by the first divided core part and the second divided core part. If so, structure including the leg cores and second yoke core that are arranged as separate members can be utilized to inductively heat the cup-shaped metallic bodies without performing processing such as dividing a leg core.

If a cross sectional area of each of the leg cores is limited by a relationship with an inside diameter of each of the cup-shaped metallic bodies, by increasing a frequency of the AC voltage applied to the input windings, a magnetic flux density can be kept equal to or less than a saturation magnetic flux density with the required input voltage being ensured. However, this case causes a problem that the increase in frequency causes an increase in iron loss to increase temperature of the leg cores. In order to preferably solve the problem with use of the structure of the involute core, desirably, cooling pipes are provided in close contact with inner circumferential surfaces of the plurality of leg cores, and a cooling medium is circulated in the cooling pipes to thereby cool the plurality of leg cores.

In order to easily attach/detach the cup-shaped metallic bodies, the cup-shaped metallic body induction heating apparatus is desirably provided with an attachment/detachment mechanism that moves at least one divided core part of the plurality of divided core parts between a sandwiching position where the cup-shaped metallic bodies are sandwiched by the plurality of divided core parts and a detachment position where the cup-shaped metallic bodies can be detached from the divided core parts.

Advantageous Effects of Invention

According to the present invention configured as described, an annular or cup-shaped metallic body made of non-magnetic metal can be uniformly heated, and also a plurality of cup-shaped metallic bodies can be simultaneously heated to improve productivity.

BEST MODE FOR CARRYING OUT THE INVENTION

Figure 1:
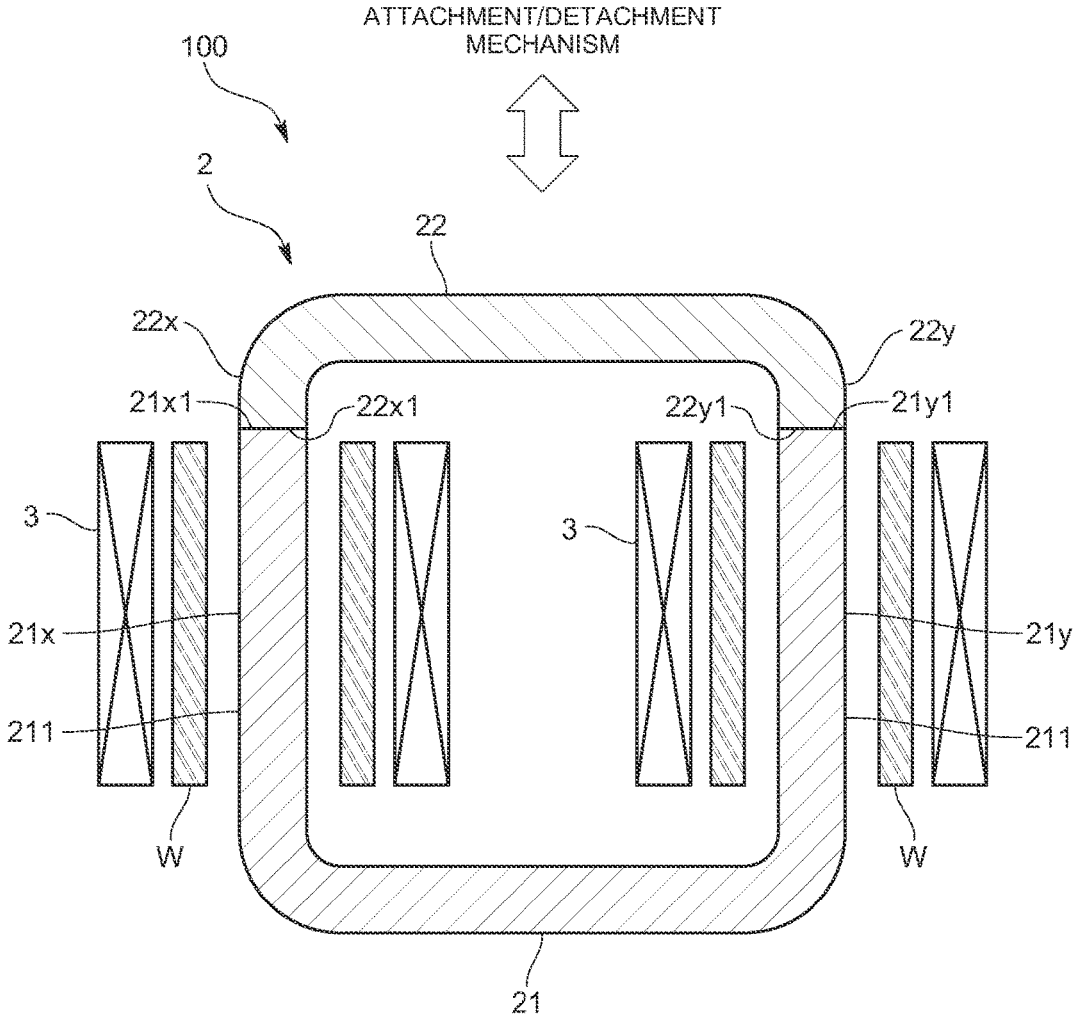
FIG. 1 is a vertical end view illustrating a schematic configuration of a first embodiment of an annular metallic body induction heating apparatus.

In the following, one embodiment of an annular metallic body induction heating apparatus according to the present invention is described referring to the drawings.

1. First Embodiment of Annular Metallic Body Induction Heating Apparatus

An annular metallic body induction heating apparatus 100 according to a first embodiment is one that inductively heats annular metallic bodies W made of non-magnetic metal such as stainless steel or aluminum to heat-treat them.

Specifically, this apparatus 100 is, as illustrated in FIG. 1, one that has a plurality of divided core parts 21 and 22 that are formed by dividing an annular core 2; is configured such that a plurality of divided end parts 21*x* and 21*y* of the divided core parts 21 and 22 are respectively attached with the annular metallic bodies W to thereby make the annular core 2 penetrate through the plurality of annular metallic bodies W; and applies an AC voltage to input windings 3 provided in outer or inner circumferential parts of the annular metallic bodies W to inductively heat the annular metallic bodies W. In addition, the annular metallic body induction heating apparatus 100 is one that simultaneously inductively heats the plurality of annular metallic bodies W formed in the same shape.

The annular core 2 is one that is configured to be a cut core type wound core and formed in a substantially rectangular annular shape, and divided into the first divided core part 21 and the second divided core part 22 that comprise a cut core. The first divided core part 21 and the second divided core part 22 are respectively formed in substantially U-shapes in a front view.

In the first divided core part 21 positioned on a lower side, the two divided end parts 21*x* and 21*y* on left and right sides thereof are respectively attached with the annular metallic bodies W with being surrounded by the annular metallic bodies W. That is, the two divided end parts 21*x* and 21*y* are inserted so as to penetrate through the annular metallic bodies W, respectively. Each of the two divided end parts 21*x* and 21*y* includes a linear vertical part (leg core part) in the first divided core part 21. Also, each of the vertical parts (leg core parts) 211 in the first divided core part 21 is configured to be longer than a length dimension of each of the annular metallic bodies W (specifically, an axial length dimension of a side peripheral wall). In addition, each of the vertical parts 211 (in particular, the divided end parts 21*x* and 21*y*) of the first divided core part 21 has a cross-sectional area enabling the vertical part 211 to be inserted into a corresponding one of the annular metallic bodies W.

The second divided core part 22 positioned on an upper side is configured to be movable forward and backward with respect to the first divided core part 21 by an attachment/detachment mechanism (not illustrated in FIG. 1), and fore end surfaces (planar cur surfaces 22*x*1 and 22*y*1) of two divided end parts 22*x* and 22*y* on left and right sides thereof are brought into contact with fore end surfaces (planar cut surfaces 21*x*1 and 21*y*1) of the two divided end parts 21*x* and 21*y* on the left and right sides of the first divided core part 21. This causes the first divided core part 21 and the second divided core part 22 to form a closed magnetic path. In addition, the divided end parts 22*x* and 22*y* of the second divided core part 22 respectively have substantially the same cross-sectional areas as those of the divided end parts 21*x* and 21*y* of the first divided core part 21.

Also, as described above, the respective outer circumferential parts of the two annular metallic bodies W set up in the first divided core part 21 are provided with the input windings 3 that are applied with the single-phase AC voltage by a midfrequency power source with a frequency of 50 Hz to 1000 Hz (not illustrated). The input windings 3, the annular metallic bodies W, and the divided end parts 21*x* and 21*y* are concentrically arranged, respectively, which improves a power factor to improve heating efficiency. A vertical winding width of each of the input windings 3 is substantially the same as the outside length dimension of each of the annular metallic bodies W. Also, by applying the single-phase AC voltage to the input windings 3, secondary currents (short-circuit currents) are induced in the annular metallic bodies W through magnetic flux generated in the first divided core part 21 and the second divided core part 22, and the annular metallic bodies W inductively generate heat to be thereby heated, respectively.

According to the annular metallic body induction heating apparatus 100 of the present embodiment configured as described, by attaching the annular metallic bodies W to the divided end parts 21$x$ and 21$y$ of the first divided core part 21 and applying the AC voltage to the input windings 3, the short-circuit currents flow in the annular metallic bodies W to cause the induction heat generation, and therefore the annular metallic bodies W can be efficiently heated. Also, the annular metallic bodies W are respectively attached to the two divided end parts 21$x$ and 21$y$ of the first divided core part 21, so that the two annular metallic bodies W can be inductively heated by the one annular core 2, and therefore the two annular metallic bodies W can be simultaneously heated to improve productivity.

Next, the attachment/detachment mechanism 4 in the annular metallic body induction heating apparatus 100 of the present embodiment is described.

Figure 2:
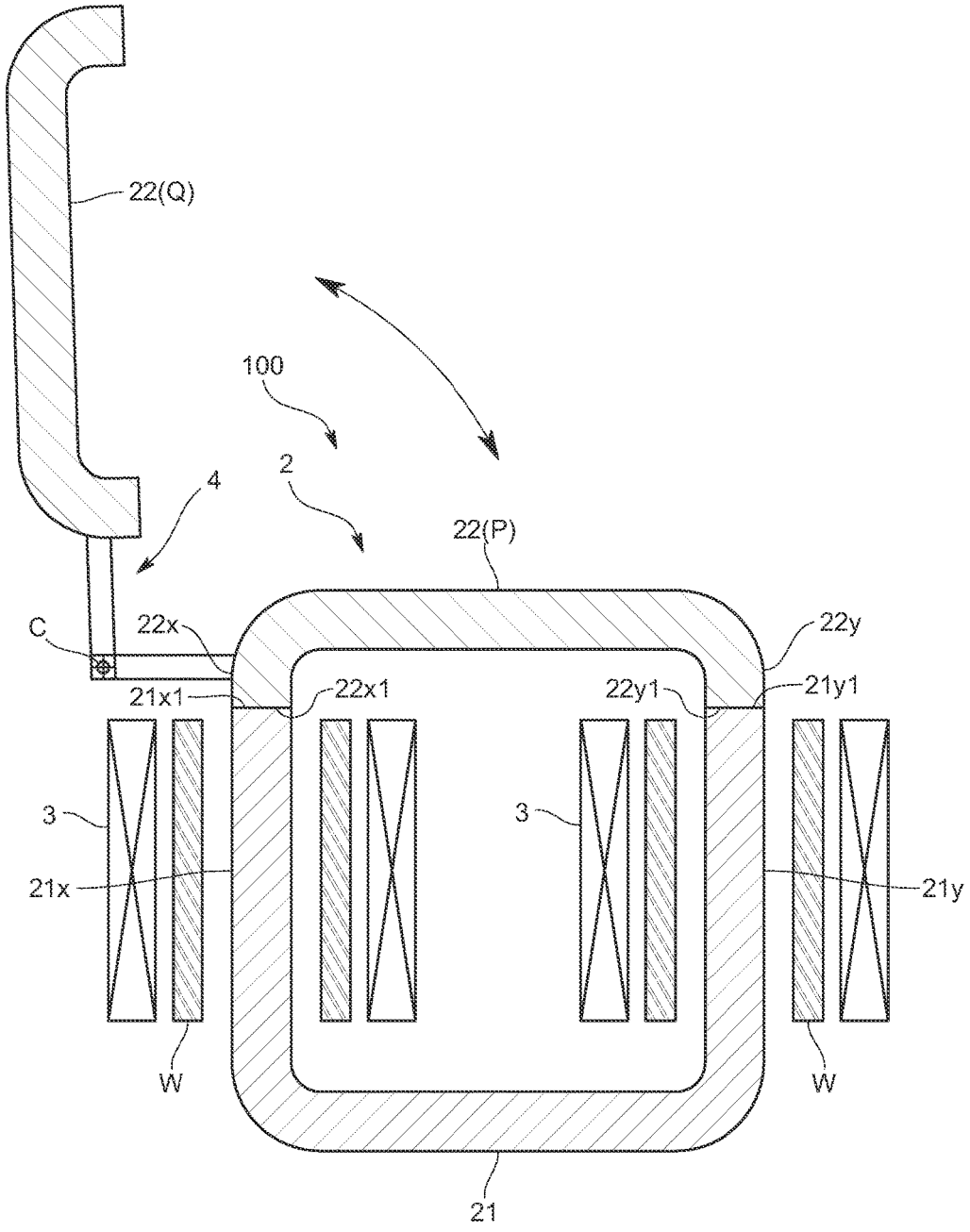
FIG. 2 is a vertical end view illustrating a specific configuration of an attachment/detachment mechanism.

The attachment/detachment mechanism 4 of the present embodiment is, as illustrated in FIG. 2, one that moves forward and backward the second divided core part 22 positioned on the upper side with respect to the first divided core part 21 positioned on the lower part, and thereby enables the annular metallic bodies W to be attached to or detached from the first divided core part 21. That is, the attachment/detachment mechanism 4 is one that moves the second divided core part 22 positioned on the upper side between an attachment position P where the annular metallic bodies W are attached to the first divided core part 21 and the two divided core parts 21 and 22 form the closed magnetic path and a detachment position Q where the annular metallic bodies W can be detached from the divided end parts 21$x$ and 21$y$ of the first divided core part 21. In addition, the detachment position Q corresponds to a state where the second divided core part 22 is separated from the first divided core part 21, and an upper part of the first divided core part 21 is opened.

Specifically, as the attachment/detachment mechanism 4, for example, a mechanism using a hydraulic mechanism is possible, and the attachment/detachment mechanism 4 may employ a method that, as illustrated in FIG. 2, manually or automatically, rotates the second divided core part 22 around a predetermined rotating shaft C as a rotational center to open the upper part of the first divided core part 21; separates the second divided core part 22 upward from the first divided core part 21 to open the upper part of the first divided core part 21; or separates the second divided core part 22 laterally to the first divided core part 21 to open the upper part of the first divided core part 21, or another method. In addition, in the state where the upper part of the first divided core part 21 is opened, the annular metallic bodies W are attached or detached.

Further, any method that moves the respective members in any manner is also possible if the method opens the upper part of the first divided core part 21. For example, a possible method is one that separates the first divided core part 21 downward from the second divided core part 22; rotates the first divided core part 21 around a predetermined rotating shaft as a rotational center; or moves the first divided core part 21 laterally.

2. Second Embodiment of Annular Metallic Body Induction Heating Apparatus

Next, an annular metallic body induction heating apparatus 100 according to a second embodiment of the present invention is described. The annular metallic body induction heating apparatus 100 according to the second embodiment is different in configuration of an annular core 2 from the first embodiment.

Figure 3:
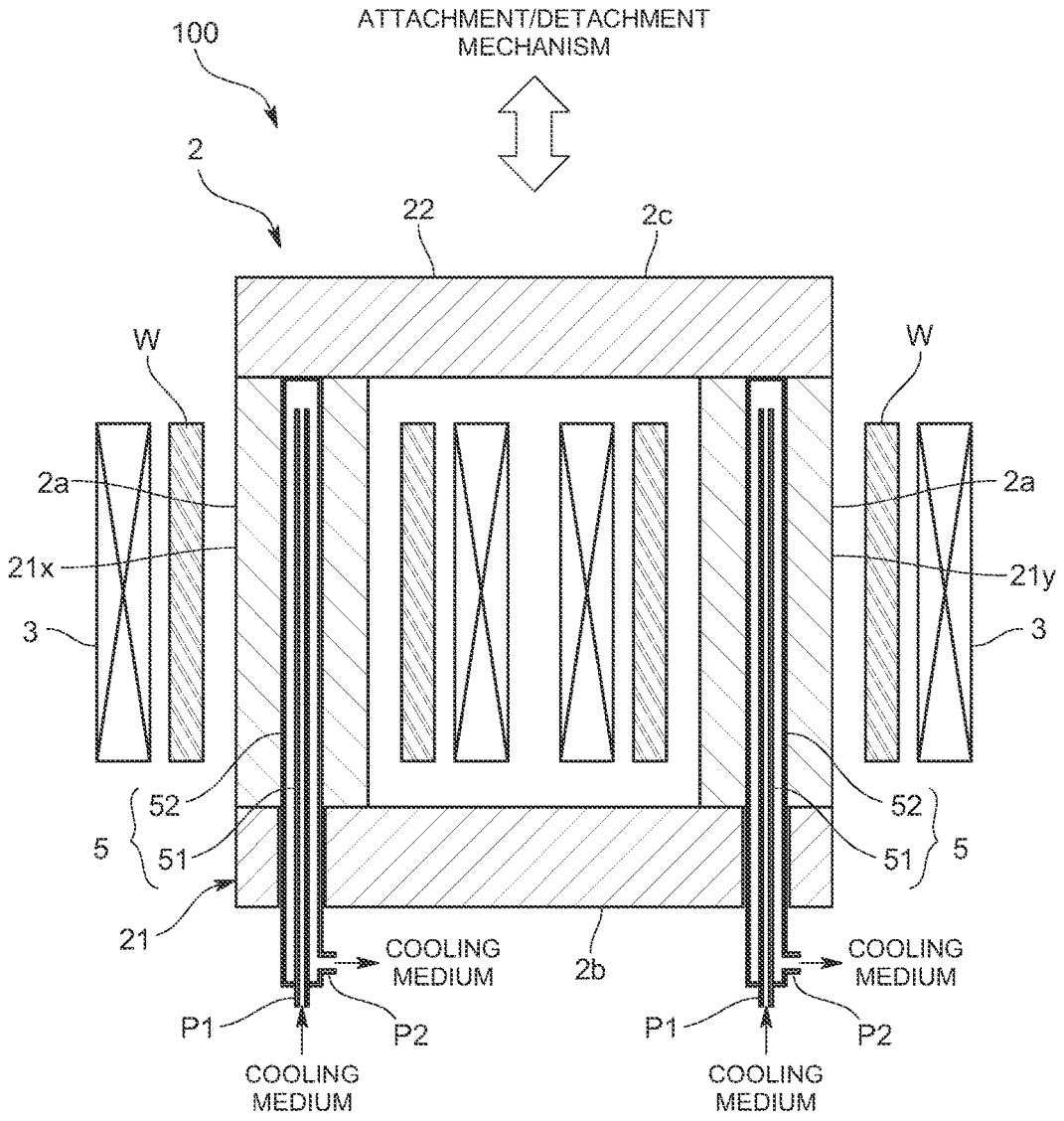
FIG. 3 is a vertical end view illustrating a schematic configuration of a second embodiment of the annular metallic body induction heating apparatus.

The annular core 2 of the present embodiment is, as illustrated in FIG. 3, configured to include: two leg cores 2$a$ and 2$a$; a first yoke core 2$b$ that is connected to one end parts (lower end parts) of the two leg cores 2$a$ and 2$a$; and a second yoke core 2$c$ that is connected to the other end parts (upper end parts) of the two leg cores 2$a$ and 2$a$. Also, each of the two leg cores 2$a$ and 2$a$ is a cylindrically-shaped involute core in which a number of magnetic steel sheets each having a curved part curved into an involute shape are radially stacked in a circumferential direction to form the cylindrical shape.

The annular core 2 having such a configuration is divided into a first divided core part 21 including the two leg cores 2$a$ and 2$a$ and the first yoke core 2$b$; and a second divided core part 22 including the second yoke core 2$c$.

Two divided end parts 21$x$ and 21$y$ (two leg cores 2$a$ and 2$a$) on left and right sides of the first divided core part 21 positioned on a lower side are respectively attached with annular metallic bodies W with being surrounded by the annular metallic bodies W. That is, the two leg cores 2$a$ and 2$a$ are inserted so as to penetrate through the annular metallic bodies W, respectively. The two divided end parts 21$x$ and 21$y$ are configured to include the two cylindrically-shaped leg cores 2$a$ and 2$a$ in the first divided core part 21. Also, each of the leg cores 2$a$ and 2$a$ in the first divided core part 21 is configured to be longer than a length dimension of each of the annular metallic bodies W, and has a cross-sectional area enabling the leg core 2$a$ to be inserted into a corresponding one of the annular metallic bodies W.

The second divided core part 22 positioned on an upper side is configured to be movable forward and backward with respect to the first divided core part 21 by an attachment/detachment mechanism, and a lower surface thereof is brought into contact with fore end surfaces (upper end surfaces of the two leg cores 2$a$ and 2$a$) of the two divided end parts 21$x$ and 21$y$ on the left and right sides of the first divided core part 21. This causes the first divided core part 21 and the second divided core part 22 to form a closed magnetic path.

Also, the annular core 2 of the present embodiment is provided with cylindrically-shaped cooling pipes 5 that are provided in close contact with circular-shaped inner circumferential surfaces of the leg cores 2$a$, and configured to cool the leg cores 2$a$ by circulating a cooling medium in the cooling pipes 5, respectively.

The cooling pipes 5 are provided so as to vertically penetrate through the leg cores 2$a$ and the first yoke core 2$b$, and in end parts positioned below the first yoke core 2$b$, have introduction ports P1 for introducing the cooling medium and lead-out ports P2 for leading out the cooling medium, respectively. The introduction ports P1 are connected with a cooling medium supply pipe (not illustrated), whereas the lead-out ports P2 are connected with a cooling medium lead-out pipe (not illustrated), and by supplying the cooling medium from a cooling medium source connected to the pipes, the cooling medium is circulated in the cooling pipes 5. Temperature and a flow rate of the cooling medium are controlled by an unillustrated temperature control mechanism such as a heat exchanger and an unillustrated flow rate control device or the like such as a mass flow controller, respectively.

Specifically, each of the cooling pipes 5 is made of stainless steel; has double-pipe structure in which the introduction port P1 and the lead-out port P2 are provided in the same end part (lower end part); and is configured such that the cooling medium passes through an inner pipe 51 from the introduction port P1, flows between the inner pipe 51 and an outer pipe 52, and is led out of the lead-out port P2 provided in the outer pipe 52. In addition, the second yoke core 2$c$ on the upper side is configured to be attachable/ detachable to/from the leg cores 2*a*, and therefore to prevent the attachment/detachment of the yoke core 2*a* from being interrupted, the cooling pipes 5 of the present embodiment are configured not to project above the leg cores 2*a* but to substantially level upper end surfaces of the cooling pipes 5 and upper end surfaces of the leg cores 2*a*. For this reason, the introduction ports P1 and the lead-out ports P2 are configured to be positioned below the first yoke core 2*b*.

Note that in the cooling pipes 5, it is desirable to provide spiral ribs or grooves on outer circumferential surfaces of the inner pipes 51 and inner circumferential surfaces of the outer pipes 52. The spiral ribs or grooves cause the cooling medium to be stirred in spaces between the inner pipes 51 and the outer pipes 52, and therefore a heat exchange between the outer pipes 52 and the leg cores 2*a* can be efficiently made, respectively. Also, by filling gaps between the cooling pipes 5 and the leg cores 2*a* with an adhesive superior in heat resistance and thermal conductivity, such as epoxy resin, the leg cores and the like can be further efficiently cooled.

According to the annular metallic body induction heating apparatus 100 of the second embodiment configured as described, by attaching the annular metallic bodies W to the involute cores and applying an AC voltage to input windings 3, short-circuit currents flow in the annular metallic bodies W to cause induction heat generation, and therefore the annular metallic bodies W can be efficiently heated. Also, the annular metallic bodies W are respectively attached to the two leg cores 2*a* and 2*a* on the left and right sides, so that the two annular metallic bodies W can be inductively heated by the one annular core 2, and therefore the two annular metallic bodies W can be simultaneously heated to improve productivity.

In particular, in the present embodiment, the involute cores 2*a* are cooled by the cooling pipes 5, and therefore a magnetic flux density can be kept equal to or less than a saturation magnetic flux density in spite of increasing a frequency of the AC voltage applied to the input windings 3 to efficiently heat the annular metallic bodies W.

Note that the present invention is not limited to any of the above-described embodiments.

Figure 4:
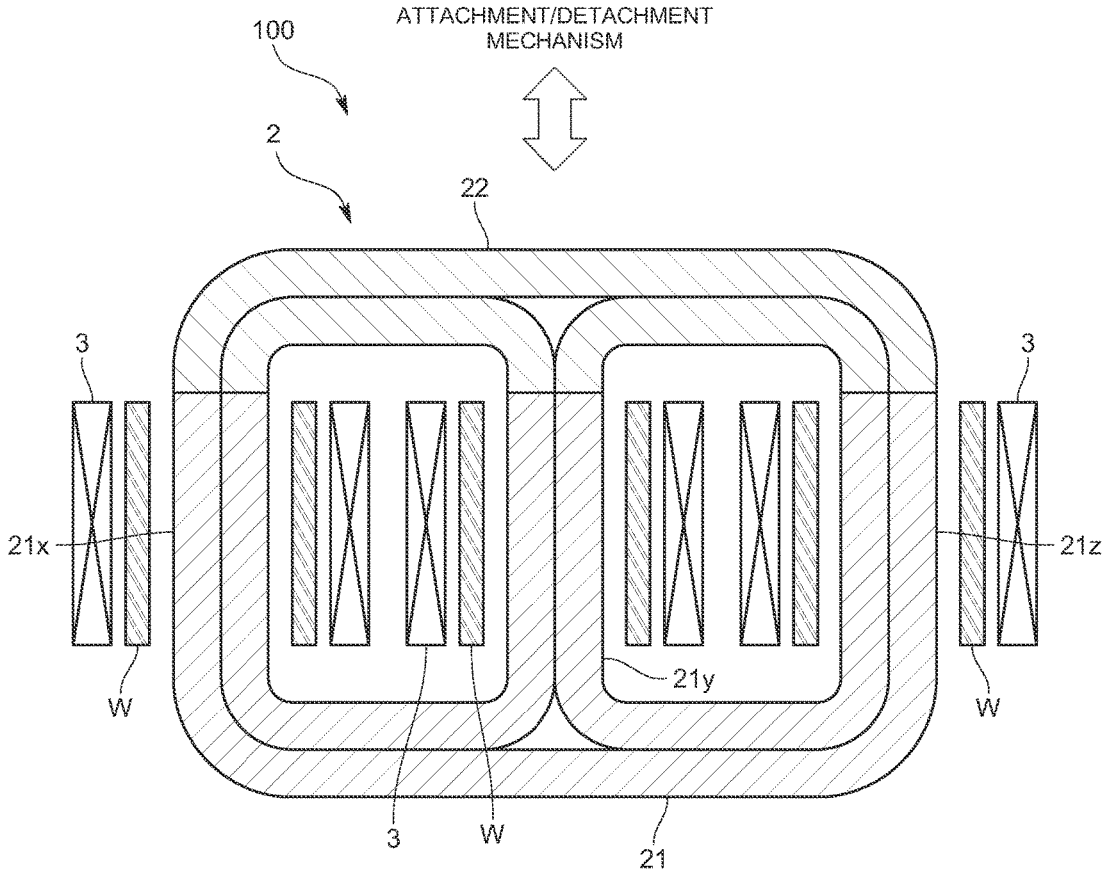
FIG. 4 is a vertical end view illustrating a schematic configuration of a variation of the annular metallic body induction heating apparatus.

For example, as illustrated in FIG. 4, in an annular core 2 configured with use of a cut core type wound core, the annular core 2 may be configured to have three leg core parts such that a first divided core part 21 and a second divided core part 22 are respectively formed in substantially E-shapes in a front view. In this case, in the first divided core part 21, three divided end parts 21*x*, 21*y*, and 21*z* positioned from left to right thereof are respectively attached with annular metallic bodies W with being surrounded by the annular metallic bodies W. Also, three input windings 3 are provided corresponding to the respective annular metallic bodies W. The three input windings 3 are applied with three-phase AC voltage by a three-phase power source. Such a configuration enables the three annular metallic bodies W to be simultaneously inductively heated by one annular metallic body induction heating apparatus.

Figure 5:
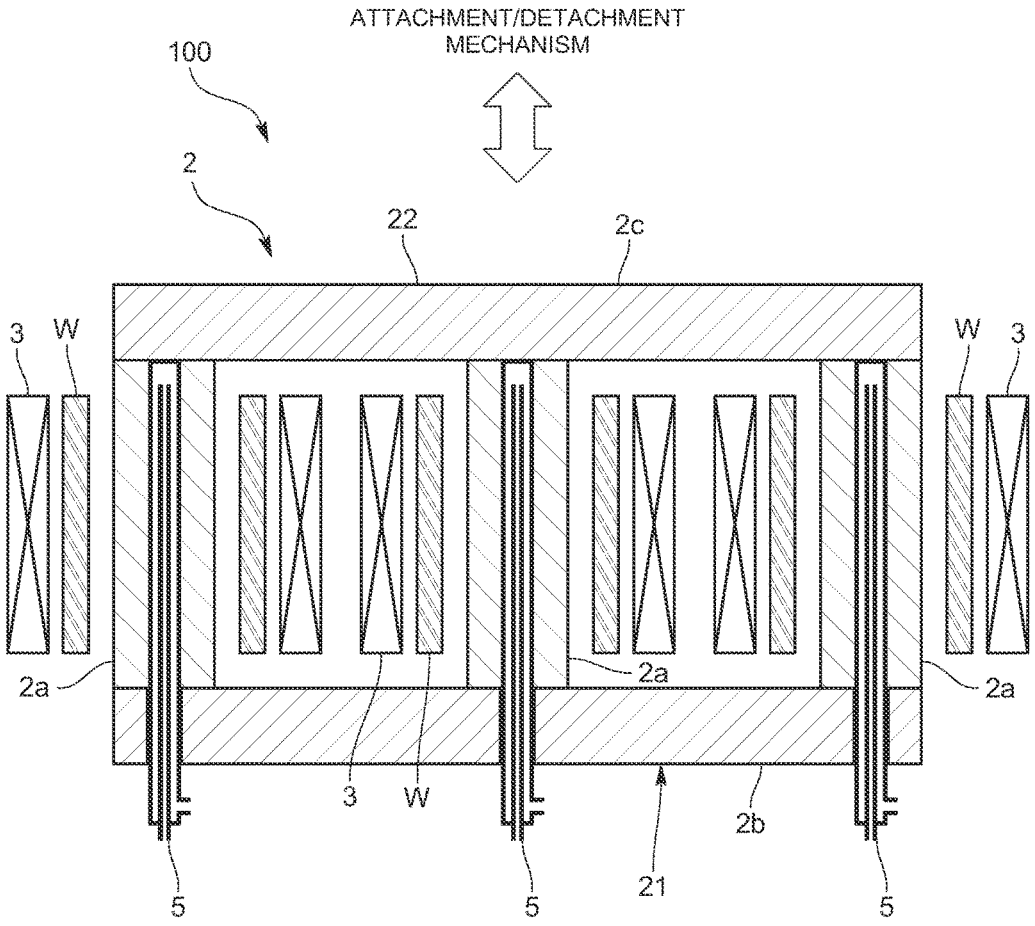
FIG. 5 is a vertical end view illustrating a schematic configuration of a variation of the annular metallic body induction heating apparatus.

Also, as illustrated in FIG. 5, an annular core 2 configured with use of involute cores (leg cores) 2*a* and yoke cores 2*b* and 2*c* may be configured to have three involute cores (leg cores). In this case, the three involute cores 2*a*, 2*a*, and 2*a* and the first yoke core 2*b* comprise a first divided core part 21. Even such a configuration enables three annular metallic bodies W to be simultaneously inductively heated by one annular metallic body induction heating apparatus 100.

Figure 6:
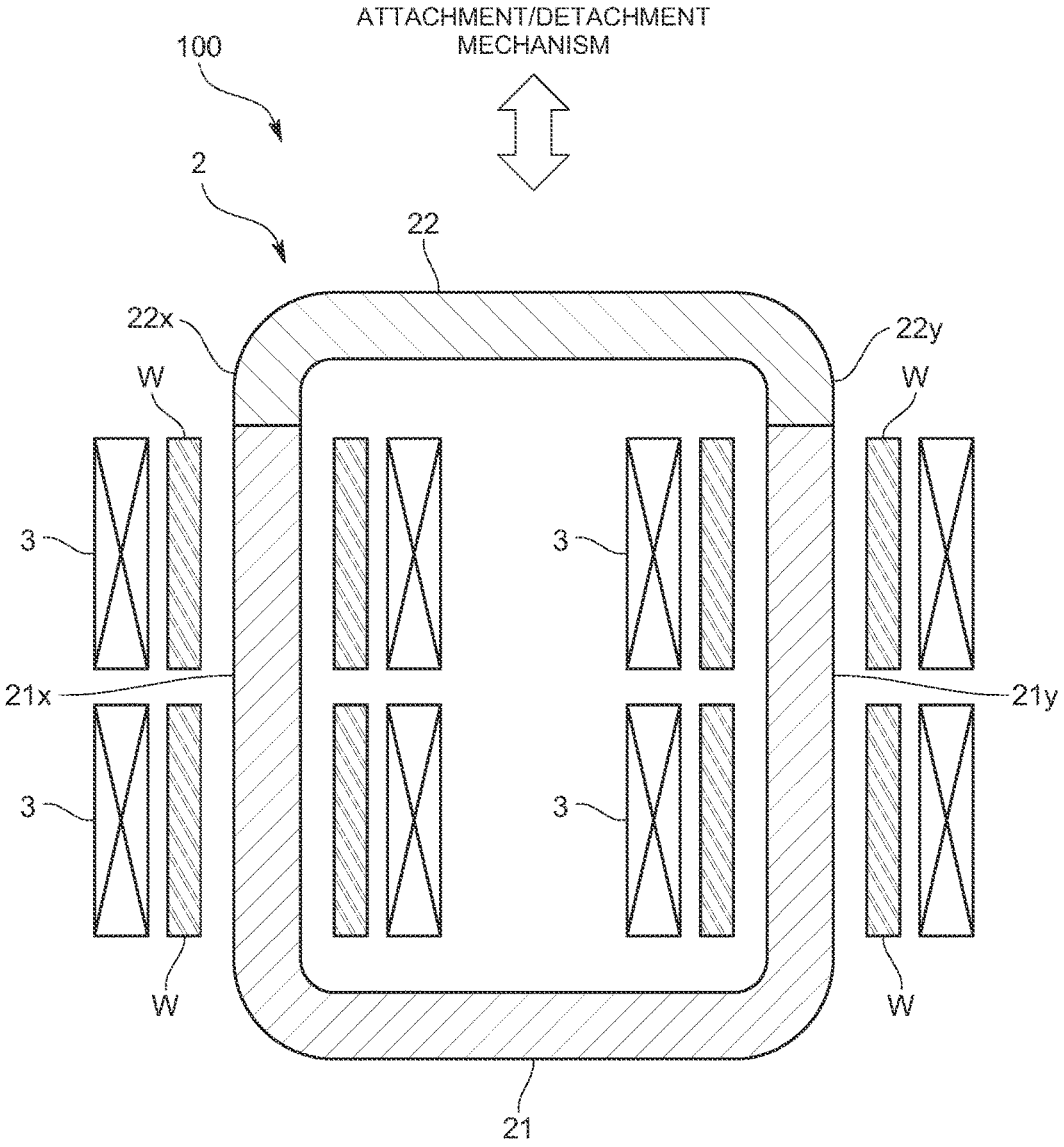
FIG. 6 is a vertical end view illustrating a schematic configuration of a variation of the annular metallic body induction heating apparatus.

Further, in any of the above-described embodiments, each of the divided end parts 21*x* and 21*y* of the first divided core part 21 is attached with the one annular metallic body W; however, as illustrated in FIG. 6, the present invention may be configured to attach two annular metallic bodies W to each of the divided end parts 21*x* and 21*y* of the first divided core part 21 and provide each of outer circumferential parts of the annular metallic bodies W with an input winding 3. With this, in an annular core 2 having two leg cores, four annular metallic bodies W can be simultaneously inductively heated, and in an annular core 2 having three leg cores, six annular metallic bodies W can be simultaneously inductively heated.

Figure 7:
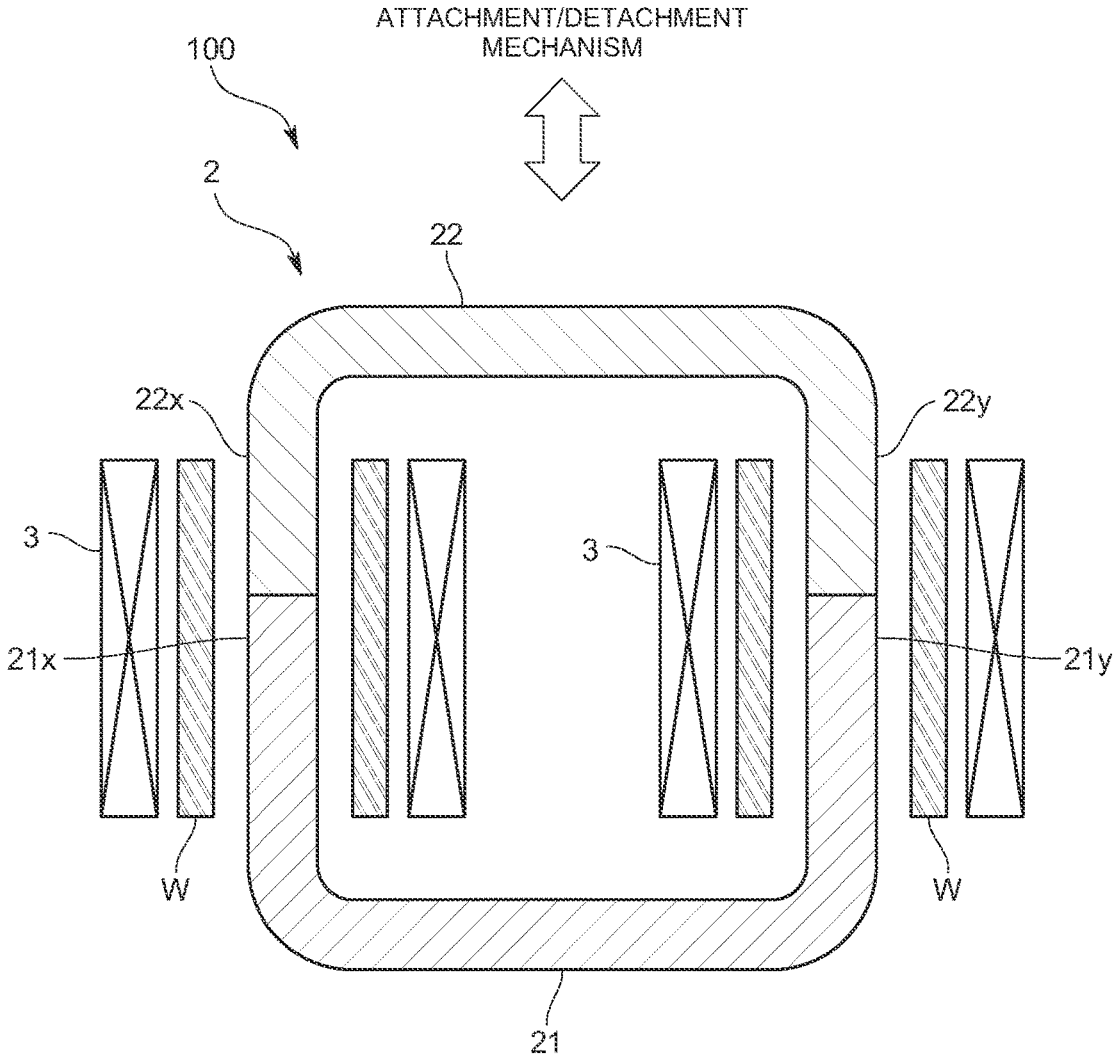
FIG. 7 is a vertical end view illustrating a schematic configuration of a variation of the annular metallic body induction heating apparatus.

Still further, as illustrated in FIG. 7, the present invention may be configured such that both of the one divided end part 21*x* of the first divided core part 21 and the one divided end part 22*x* of the second divided core part 22, and both of the other divided end part 21*y* of the first divided core part 21 and the other divided end part 22*y* of the second divided core part 22 are attached with the annular metallic bodies W with being surrounded by the annular metallic bodies W.

In addition, in the above-described second embodiment, instead of the cooling pipes 5, heat pipes may be provided in close contact with the inner circumferential surfaces of the leg cores. In this case, even if the heat pipes are configured to project one end part thereof outward from lower surfaces of the leg cores and cool projected parts, the same effect as that of the above-described embodiment can be obtained.

Also, in any of the above-described embodiments, the input windings 3 are provided in the outer circumferential parts of the annular metallic bodies W; however, the input windings 3 may be provided in the inner circumferential parts of the annular metallic bodies W.

Next, one embodiment of a cup-shaped metallic body induction heating apparatus according to the present invention is described referring to the drawings.

3. First Embodiment of Cup-Shaped Metallic Body Induction Heating Apparatus

A cup-shaped metallic body induction heating apparatus 100 according to a first embodiment is one that inductively heats cup-shaped metallic bodies W, each of which is made of non-magnetic metal such as stainless steel and formed in a bottom-equipped tubular shape, to heat-treat them. In addition, as the cup-shaped metallic body W, for example, a metallic can container, a metal mold, or the like is possible.

Figure 8:
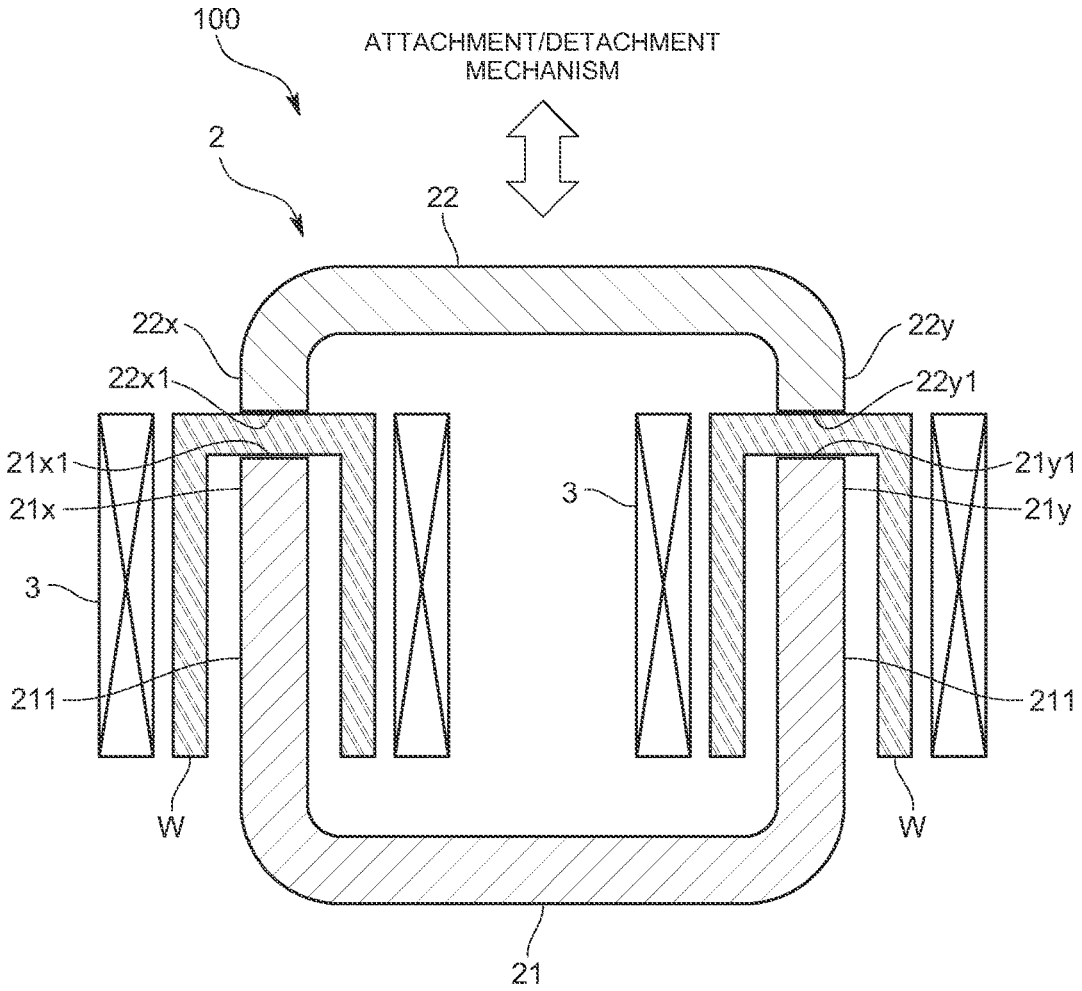
FIG. 8 is a vertical end view illustrating a schematic configuration of a first embodiment of a cup-shaped metallic body induction heating apparatus.

Specifically, this apparatus 100 is, as illustrated in FIG. 8, one that has a plurality of divided core parts 21 and 22 that are formed by dividing an annular core 2; is configured such that cup-shaped metallic bodies W are sandwiched by the plurality of divided core parts 21 and 22 with respectively covering a plurality of divided end parts 21*x* and 21*y* of the divided core parts 21 and 22; and applies an AC voltage to input windings 3 provided in outer or inner circumferential parts of the cup-shaped metallic bodies W to inductively heat the cup-shaped metallic bodies W. In addition, the cup-shaped metallic body induction heating apparatus 100 is one that simultaneously inductively heats the plurality of cup-shaped metallic bodies W formed in the same shape.

The annular core 2 is one that is configured to be a cut core type wound core and formed in a substantially rectangular annular shape, and divided into the first divided core part 21 and the second divided core part 22 that comprise a cut core. The first divided core part 21 and the second divided core part 22 are respectively formed in substantially U-shapes in a front view.

The first divided core part 21 positioned on a lower side is set up with the two divided end parts 21*x* and 21*y* on left and right sides thereof being respectively covered with the cup-shaped metallic bodies W. At this time, inner surfaces of bottom walls of the cup-shaped metallic bodies W are in contact with or close to fore end surfaces (planar cut surfaces 21$x$1 and 21$y$1) of the divided end parts 21$x$ and 21$y$ of the first divided core part 21, respectively. Also, each of vertical parts (leg core parts) 211 in the first divided core part 21 is configured to be longer than a length dimension (specifically, a depth dimension or the like) of each of the cup-shaped metallic bodies W. In addition, each of the vertical parts 211 (in particular, the divided end parts 21$x$ and 21$y$) of the first divided core part 21 is one that has a cross-sectional area enabling the vertical part 211 to be inserted into a corresponding one of the cup-shaped metallic bodies W.

The second divided core part 22 positioned on an upper side is configured to be movable forward and backward with respect to the first divided core part 21 by an attachment/detachment mechanism (not illustrated in FIG. 8), and fore end surfaces (planar cur surfaces 22$x$1 and 22$y$1) of two divided end parts 22$x$ and 22$y$ on left and right sides thereof are in contact with or close to outer surfaces of the bottom walls of the cup-shaped metallic bodies W set up on the first divided core part 21. On the basis of this, the cup-shaped metallic bodies W are set up with being sandwiched by the first divided core part 21 and the second divided core part 22. In addition, the divided end parts 22$x$ and 22$y$ of the second divided core part 22 respectively have substantially the same cross-sectional areas as those of the divided end parts 21$x$ and 21$y$ of the first divided core part 21.

Also, as described above, the respective outer circumferential parts of the two cup-shaped metallic bodies W set up on the first divided core part 21 are provided with the input windings 3 that are applied with the single-phase AC voltage by a mid-frequency power source with a frequency of 50 Hz to 1000 Hz (not illustrated). A vertical winding width of each of the input windings 3 is substantially the same as the outside length dimension of each of the cup-shaped metallic bodies W. Also, by applying the single-phase AC voltage to the input windings 3, secondary currents (short-circuit currents) are induced in the cup-shaped metallic bodies W through magnetic flux generated in the first divided core part 21 and the second divided core part 22, and the cup-shaped metallic bodies W can inductively generate heat to be thereby heated, respectively.

According to the cup-shaped metallic body induction heating apparatus 100 of the present embodiment configured as described, by covering the divided end parts 21$x$ and 21$y$ of the first divided core part 21 with the cup-shaped metallic bodies W to sandwich the cup-shaped metallic bodies W by the two divided core parts 21 and 22, and applying the AC voltage to the input windings 3, the short-circuit currents flows in the cup-shaped metallic bodies W to cause the induction heat generation, and therefore the cup-shaped metallic bodies W can be efficiently heated. Also, the two divided end parts 21$x$ and 21$y$ of the first divided core part 21 are respectively covered with the cup-shaped metallic bodies W, so that the plurality of cup-shaped metallic bodies W can be inductively heated by the one annular core 2, and therefore the plurality of cup-shaped metallic bodies W can be simultaneously heated to improve productivity.

Next, the attachment/detachment mechanism 4 in the cup-shaped metallic body induction heating apparatus 100 of the present embodiment is described.

Figure 9:
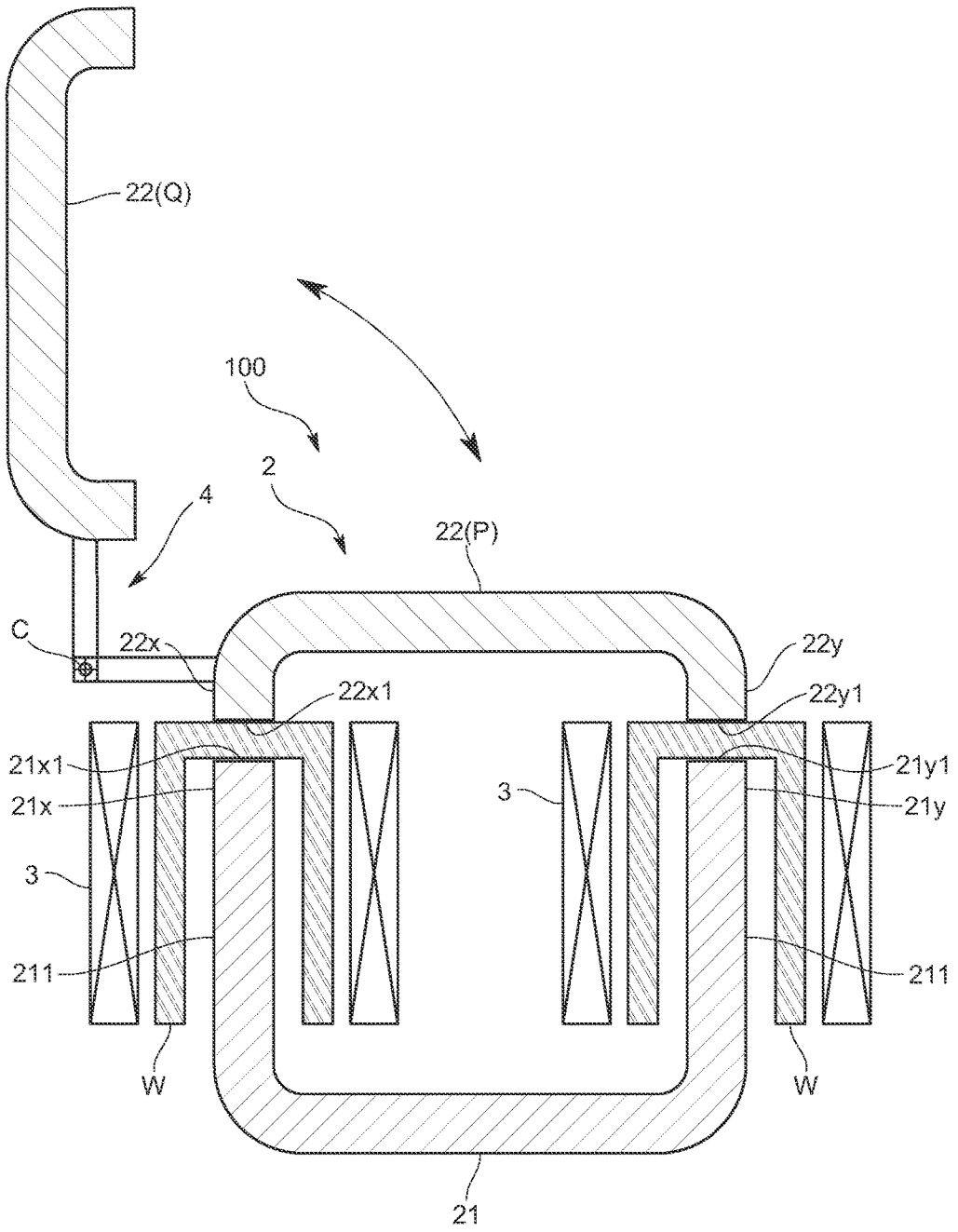
FIG. 9 is a vertical end view illustrating a specific configuration of an attachment/detachment mechanism.

The attachment/detachment mechanism 4 of the present embodiment is, as illustrated in FIG. 9, one that moves forward and backward the second divided core part 22 positioned on the upper side with respect to the first divided core part 21 positioned on the lower side, and thereby enables the cup-shaped metallic bodies W to be attached to or detached from the first divided core part 21. That is, the attachment/detachment mechanism 4 is one that moves the second divided core part 22 positioned on the upper side between a sandwiching position P where the cup-shaped metallic bodies W are sandwiched by the first divided core part 21 and the second divided core part 22 and a detachment position Q where the cup-shaped metallic bodies W can be detached from the first divided core part 21. In addition, the sandwiching position P corresponds to a state where the first divided core part 21 and the second divided core part 22 form a closed magnetic path, and the detachment position Q corresponds to a state where the second divided core part 22 is separated from the first divided core part 21, and an upper part of the first divided core part 21 is opened.

Specifically, as the attachment/detachment mechanism 4, for example, a mechanism using a hydraulic mechanism is possible, and the attachment/detachment mechanism 4 may employ a method that, as illustrated in FIG. 9, manually or automatically, rotates the second divided core part 22 around a predetermined rotating shaft C as a rotational center to open the upper part of the first divided core part 21; separates the second divided core part 22 upward from the first divided core part 21 to open the upper part of the first divided core part 21; or separates the second divided core part 22 laterally to the first divided core part 21 to open the upper part of the first divided core part 21, or another method. In addition, in the state where the upper part of the first divided core part 21 is opened, the cup-shaped metallic bodies W are attached or detached.

Further, any method that moves the respective members in any manner is also possible if the method opens the upper part of the first divided core part 21. For example, a possible method is one that separates the first divided core part 21 downward from the second divided core part 22; rotates the first divided core part 21 around a predetermined rotating shaft as a rotational center; or moves the first divided core part 21 laterally.

4. Second Embodiment of Cup-Shaped Metallic Body Induction Heating Apparatus

Next, a cup-shaped metallic body induction heating apparatus 100 according to a second embodiment of the present invention is described. The cup-shaped metallic body induction heating apparatus 100 according to the second embodiment is different in configuration of an annular core 2 from the first embodiment.

Figure 10:
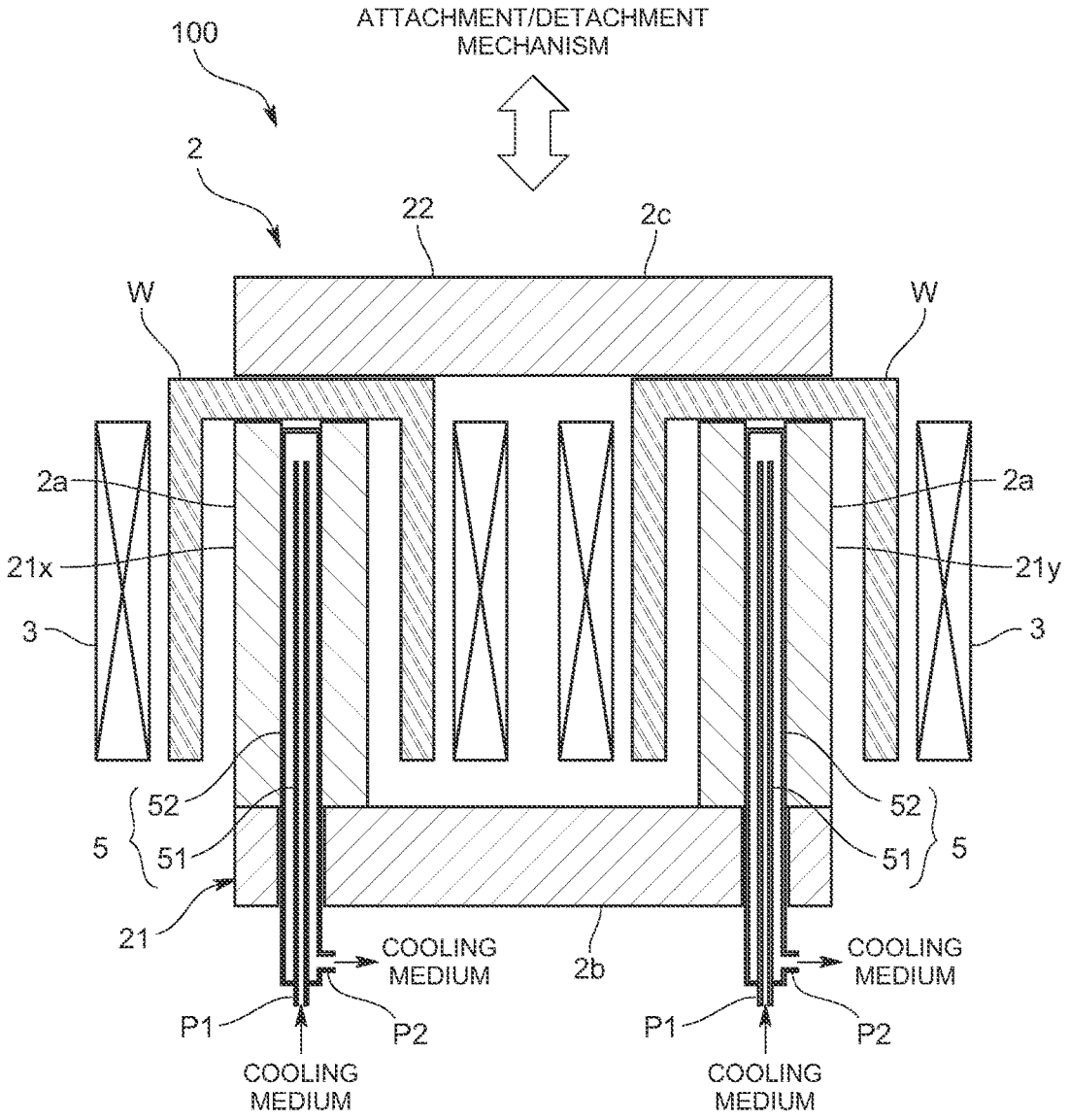
FIG. 10 is a vertical end view illustrating a schematic configuration of a second embodiment of the cup-shaped metallic body induction heating apparatus.

The annular core 2 of the present embodiment is, as illustrated in FIG. 10, configured to include: two leg cores 2$a$ and 2$a$; a first yoke core 2$b$ that is connected to one end part (lower end parts) of the two leg cores 2$a$ and 2$a$; and a second yoke core 2$c$ that is connected to the other end parts (upper end parts) of the two leg cores 2$a$ and 2$a$. Also, each of the two leg cores 2$a$ and 2$a$ is a cylindrically-shaped involute core in which a number of magnetic steel sheets each having a curved part curved into an involute shape are radially stacked in a circumferential direction to form the cylindrical shape.

The annular core 2 having such a configuration is divided into: a first divided core part 21 including the two leg cores 2$a$ and 2$a$ and the first yoke core 2$b$; and a second divided core part 22 including the second yoke core 2$c$.

Cup-shaped metallic bodies W are set up with respectively covering two divided end parts 21$x$ and 21$y$ (two leg cores 2$a$ and 2$a$) on left and right sides of the first divided core part 21 positioned on a lower side. At this time, inner surfaces of bottom walls of the cup-shaped metallic bodies W are in contact with or close to fore end surfaces (upper end surfaces of the leg cores 2*a*) of the divided end parts 21*x* and 21*y* of the first divided core part 21. Also, each of the leg cores 2*a* and 2*a* in the first divided core part 21 is configured to be longer than a length dimension of each of the cup-shaped metallic bodies W, and has a cross-sectional area enabling the leg core 2*a* to be inserted into a corresponding one of the cup-shaped metallic bodies W.

The second divided core part 22 positioned on an upper side is configured to be movable forward and backward with respect to the first divided core part 21 by an attachment/detachment mechanism, and a lower surface thereof is brought into contact with or brought close to outer surfaces of the bottom walls of the cup-shaped metallic bodies W set up on the first divided core part 21. On the basis of this, the cup-shaped metallic bodies W are set up with being sandwiched by the first divided core part 21 and the second divided core part 22.

Also, the annular core 2 of the present embodiment is provided with cylindrically-shaped cooling pipes 5 that are provided in close contact with circular-shaped inner circumferential surfaces of the leg cores 2*a*, and configured to cool the leg cores 2*a* by circulating a cooling medium in the cooling pipes 5, respectively.

The cooling pipes 5 are provided so as to vertically penetrate through the leg cores 2*a* and the first yoke core 2*b*, and in end parts positioned below the first yoke core 2*b*, have introduction ports P1 for introducing the cooling medium and lead-out ports P2 for leading out the cooling medium, respectively. The introduction ports P1 are connected with a cooling medium supply pipe (not illustrated), whereas the lead-out ports P2 are connected with a cooling medium lead-out pipe (not illustrated), and by supplying the cooling medium from a cooling medium source connected to the pipes, the cooling medium is circulated in the cooling pipes 5. Temperature and a flow rate of the cooling medium are controlled by an unillustrated temperature control mechanism such as a heat exchanger and an unillustrated flow rate control device or the like such as a mass flow controller, respectively.

Specifically, each of the cooling pipes 5 is made of stainless steel; has double-pipe structure in which the introduction port P1 and the lead-out port P2 are provided in the same end part (lower end part); and configured such that the cooling medium passes through an inner pipe 51 from the introduction port P1, flows between the inner pipe 51 and an outer pipe 52, and is led out of the lead-out port P2 provided in the outer pipe 52. In addition, the second yoke core 2*c* on the upper side is configured to be attachable/detachable to/from the leg cores 2*a*, and therefore to prevent the attachment/detachment of the yoke core 2*a* from being interrupted, the cooling pipes 5 of the present embodiment are configured not to project above the leg cores 2*a* but to substantially level upper end surfaces of the cooling pipes 5 and upper end surfaces of the leg cores 2*a*. For this reason, the introduction ports P1 and the lead-out ports P2 are configured to be positioned below the first yoke core 2*b*.

Note that in the cooling pipes 5, it is desirable to provide spiral ribs or grooves on outer circumferential surfaces of the inner pipes 51 and inner circumferential surfaces of the outer pipes 52. The spiral ribs or grooves cause the cooling medium to be stirred in spaces between the inner pipes 51 and the outer pipes 52, and therefore a heat exchange between the outer pipes 52 and the leg cores 2*a* can be efficiently made. Also, by filling gaps between the cooling pipes 5 and the leg cores 2*a* with an adhesive superior in heat resistance and thermal conductivity, such as epoxy resin, the leg cores and the like can be further efficiently cooled.

According to the cup-shaped metallic body induction heating apparatus 100 of the second embodiment configured as described, by covering the upper end parts of the involute cores with the cup-shaped metallic bodies W to sandwich the cup-shaped metallic bodies W between the upper end parts and the second yoke core 2*c*, and applying an AC voltage to input windings 3, short-circuit currents flow in the cup-shaped metallic bodies W to cause induction heat generation, and therefore the cup-shaped metallic bodies W can be efficiently heated. Also, the upper end parts of the two leg cores 2*a* and 2*a* on the left and right sides are respectively covered with the cup-shaped metallic bodies W, so that the two cup-shaped metallic bodies W can be inductively heated by the one annular core 2, and therefore the two cup-shaped metallic bodies W can be simultaneously heated to improve productivity.

In particular, in the present embodiment, the involute cores 2*a* are cooled by the cooling pipes 5, and therefore a magnetic flux density can be kept equal to or less than a saturation magnetic flux density in spite of increasing a frequency of the AC voltage applied to the input windings 3 to efficiently heat the cup-shaped metallic bodies W.

Note that the present invention is not limited to any of the above-described embodiments.

Figure 11:
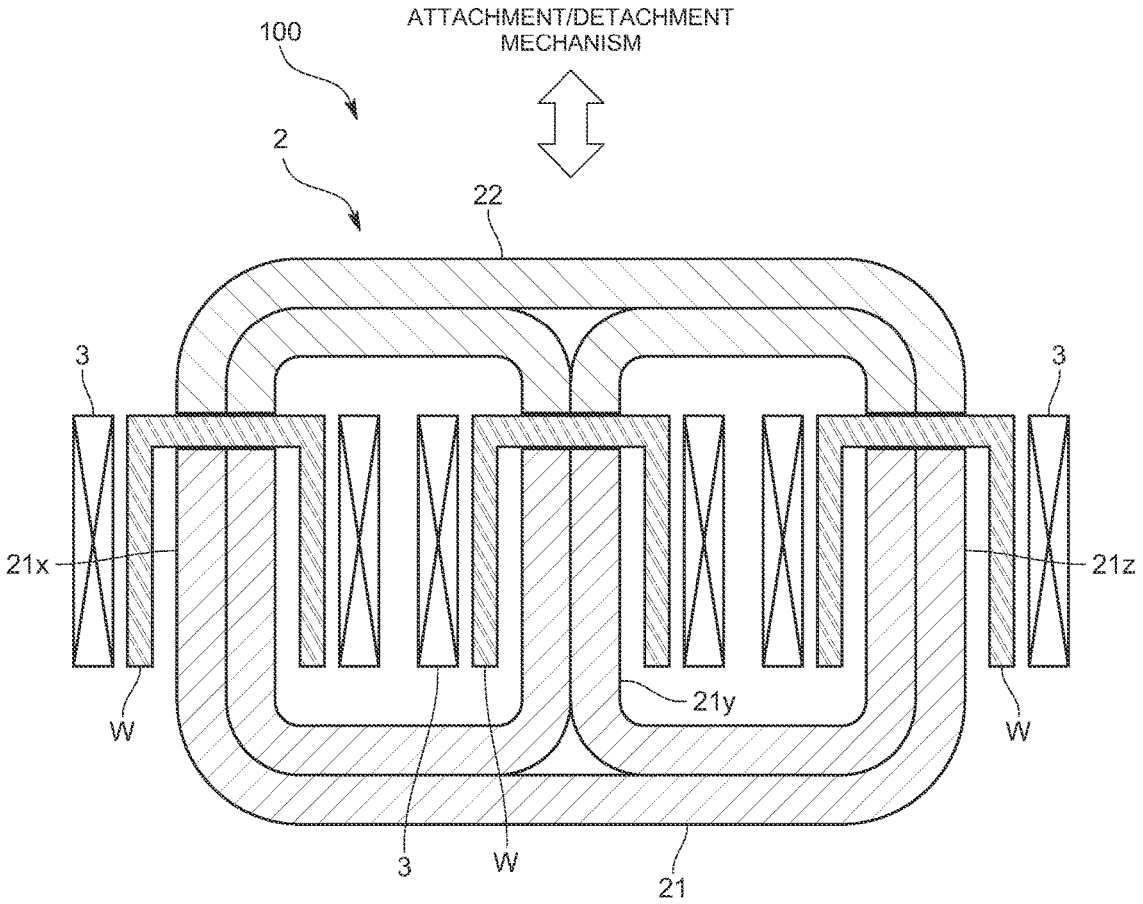
FIG. 11 is a vertical end view illustrating a schematic configuration of a variation of the cup-shaped metallic body induction heating apparatus.

For example, as illustrated in FIG. 11, in an annular core 2 configured with use of a cut core type wound core, the annular core 2 may be configured to have three leg core parts such that a first divided core part 21 and a second divided core part 22 are respectively formed in substantially E-shapes in a front view. In this case, in the first divided core part 21, cup-shaped metallic bodies W are set up with respectively covering three divided end parts 21*x*, 21*y*, and 21*z* positioned from left to right of the first divided core part 21. Also, three input windings 3 are provided corresponding to the respective cup-shaped metallic bodies W. The three input windings 3 are applied with three-phase AC voltage by a three-phase power source. Such a configuration enables the three cup-shaped metallic bodies W to be simultaneously inductively heated by one cup-shaped metallic body induction heating apparatus.

Figure 12:
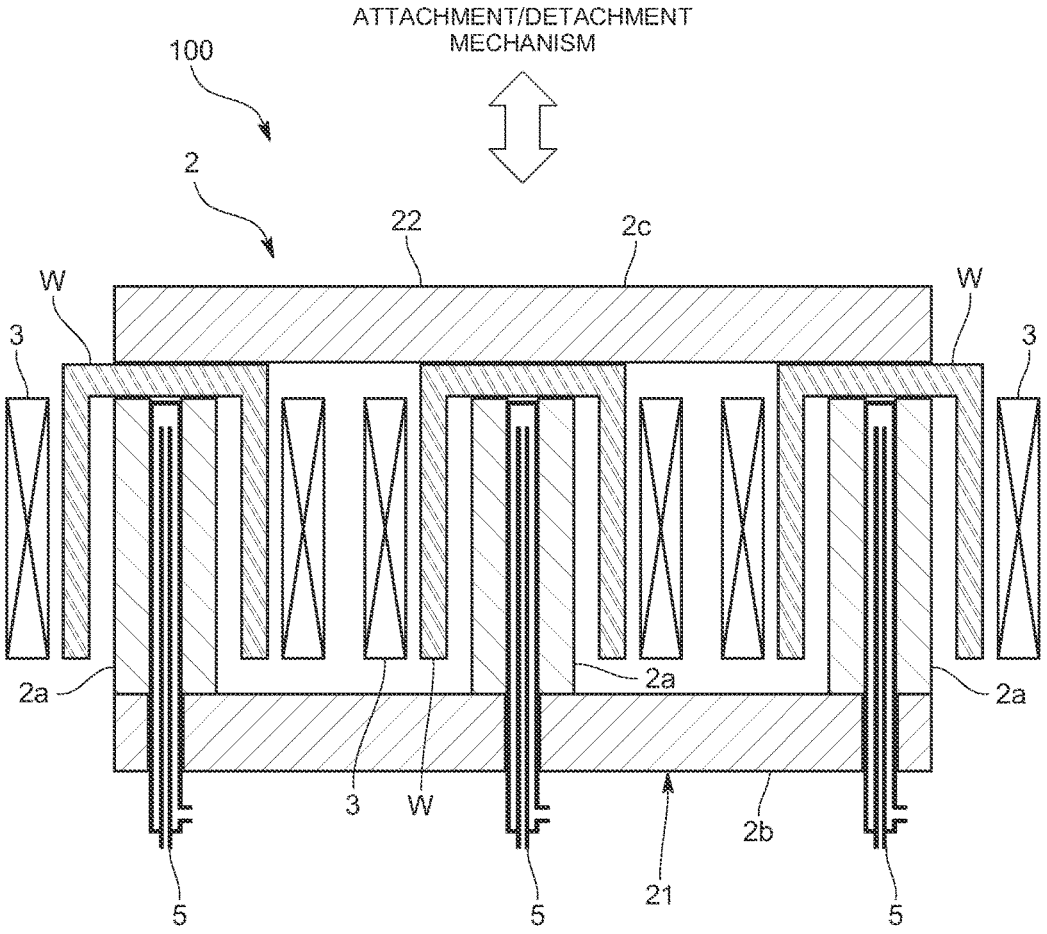
FIG. 12 is a vertical end view illustrating a schematic configuration of a variation of the cup-shaped metallic body induction heating apparatus.

Also, as illustrated in FIG. 12, an annular core 2 configured with use of involute cores (leg cores) 2*a* and yoke cores 2*b* and 2*c* may be configured to have three involute cores (leg cores). In this case, the three involute cores 2*a*, 2*a*, and 2*a* and the first yoke core 2*b* comprise a first divided core part 21. Even such a configuration enables three cup-shaped metallic bodies W to be simultaneously inductively heated by one annular metallic body induction heating apparatus 100.

Figure 13:
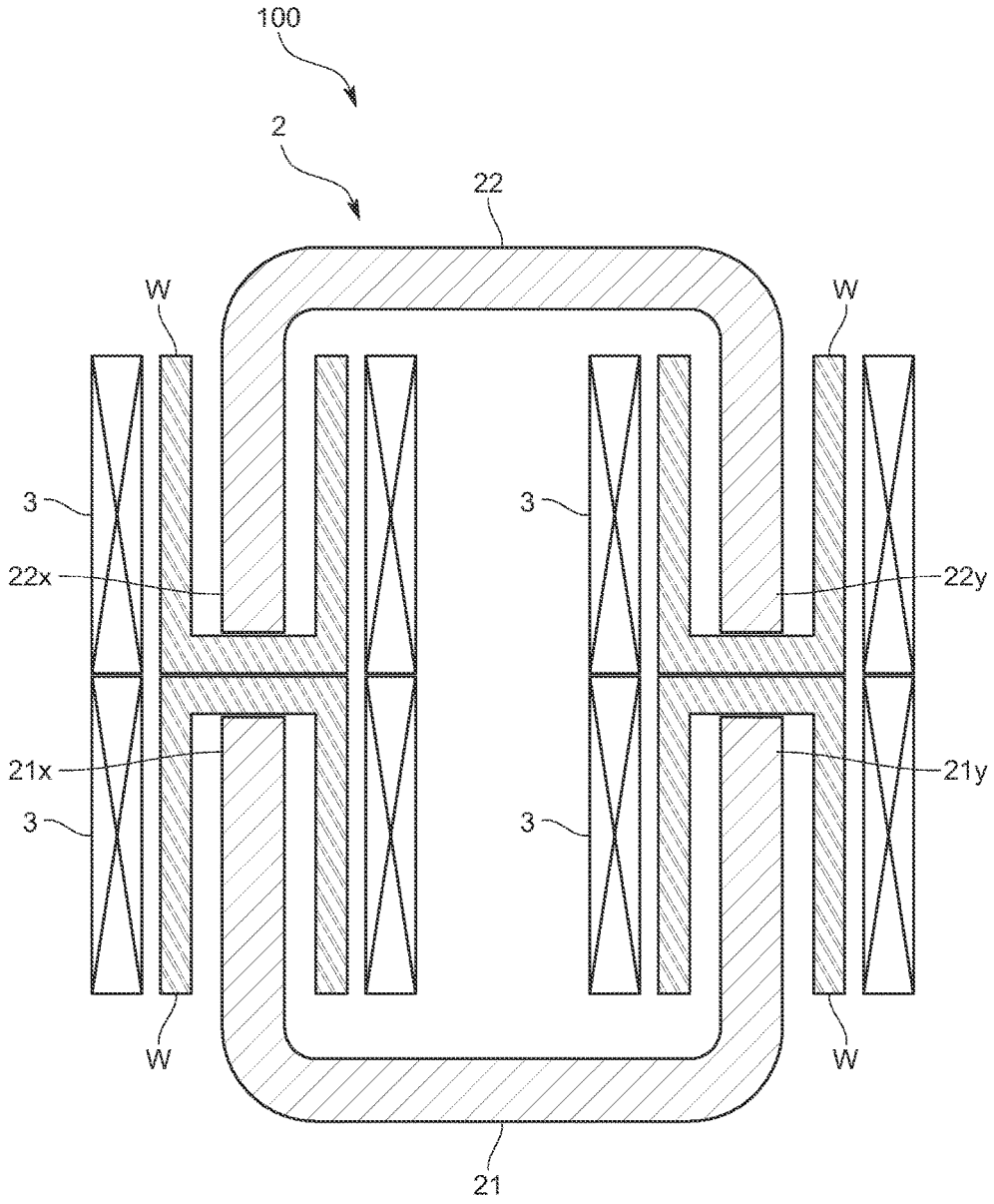
FIG. 13 is a vertical end view illustrating a schematic configuration of a variation of the cup-shaped metallic body induction heating apparatus.

Further, in any of the above-described embodiments, the divided end parts 21*x* and 21*y* of the first divided core part 21 are respectively set up with the cup-shaped metallic bodies W; however, as illustrated in FIG. 13, the present invention may be configured to, in addition to the first divided core part 21, set up the divided end parts 22*x* and 22*y* of the second divided core part 22 with cup-shaped metallic bodies W and also provide outer circumferential parts of the cup-shaped metallic bodies W with input windings 3. With this, in an annular core 2 having two leg cores, four cup-shaped metallic bodies W can be simultaneously inductively heated, and in an annular core 2 having three leg cores, six cup-shaped metallic bodies W can be simultaneously inductively heated.

Still further, in any of the above-described embodiments, the annular core 2 is vertically divided into the two divided core parts 21 and 22; however, the annular core 2 may be vertically divided into three or more divided core parts. By increasing the number of divisions as described, the number of divided end parts is increased, and therefore the number of cup-shaped metallic bodies W that can be simultaneously inductively heated can be increased.

In addition, in the above-described second embodiment, instead of the cooling pipes 5, heat pipes may be provided with being in close contact with the inner circumferential surfaces of the leg cores. In this case, even if the heat pipes are configured to project one end part thereof outward from lower surfaces of the leg cores and cool projected parts, the same effect as that of the above-described embodiment can be obtained.

Also, in any of the above-described embodiments, the input windings 3 are provided in the outer circumferential parts of the cup-shaped metallic bodies W; however, the input windings 3 may be provided in inner circumferential parts of the annular metallic bodies W.

Accordingly, it should be appreciated that the present invention is not limited to any of the above-described embodiments, but can variously modified without departing from the scope thereof.

REFERENCE CHARACTER LIST

100: Metallic body induction heating apparatus
W: Metallic body
2: Annular core
21: First divided core part
21*x*, 21*y*: Divided end part
22: Second divided core part
22*x*, 22*y*: Divided end part
2*a*: Leg core
2*b*: First yoke core
2*c*: Second yoke core
3: Input winding
4: Attachment/detachment mechanism
5: Cooling pipe

The invention claimed is:

1. An annular metallic body induction heating apparatus, comprising:

a plurality of divided core parts formed by dividing an annular core, the annular core being annularly shaped about a core axis;

a plurality of divided end parts in at least one of the divided core parts, the plurality of divided end parts respectively attached with annular metallic bodies made of non-magnetic metal to thereby make the annular core penetrate through the plurality of annular metallic bodies, the annular metallic bodies each being annularly shaped about a respective body axis; and input windings provided in respective outer circumferential parts or inner circumferential parts of the annular metallic bodies to inductively heat the annular metallic bodies by application of AC voltage, wherein the annular metallic bodies are positioned such that each body axis is perpendicular to the core axis.

2. The annular metallic body induction heating apparatus according to claim 1, wherein the annular core is configured to be a cut core type wound core.

3. The annular metallic body induction heating apparatus according to claim 2, wherein:

the annular core is divided into a first divided core part and a second divided core part that comprise a cut core; and a plurality of divided end parts in at least one of the first divided core part and the second divided core part are respectively attached with the annular metallic bodies.

4. The annular metallic body induction heating apparatus according to claim 1, wherein:

the annular core is configured to include a plurality of leg cores, a first yoke core connected to one end parts of the plurality of leg cores, and a second yoke core connected to the other end parts of the plurality of leg cores; and each of the plurality of leg cores is formed in a cylindrical shape that is formed by radially stacking a number of magnetic steel sheets each having a curved part curved into an involute shape.

5. The annular metallic body induction heating apparatus according to claim 4, wherein:

the annular core is divided into a first divided core part including the plurality of leg cores and the first yoke core, and a second divided core part including the second yoke core; and the plurality of leg cores are respectively attached with the annular metallic bodies.

6. The annular metallic body induction heating apparatus according to claim 4, wherein:

cooling pipes are provided in close contact with inner circumferential surfaces of the plurality of leg cores, and a cooling medium is circulated in the cooling pipes to thereby cool the plurality of leg cores.

7. The annular metallic body induction heating apparatus according to claim 1, wherein:

two sets of the annular metallic bodies and the input windings are provided, and an input power source that applies the AC voltage to the input windings is a single-phase power source.

8. The annular metallic body induction heating apparatus according to claim 1, wherein:

three sets of the annular metallic bodies and the input windings are provided, and an input power source that applies the AC voltage to the input windings is a three-phase power source.

9. The annular metallic body induction heating apparatus according to claim 1, the apparatus comprising an attachment/detachment mechanism that moves at least one divided core part of the plurality of divided core parts between an attachment position where the annular metallic bodies are attached and the plurality of divided core parts form a closed magnetic path and a detachment position where the annular metallic bodies can be detached from the divided end parts of the divided core parts.

10. A cup-shaped metallic body induction heating apparatus, comprising:

a plurality of divided core parts formed by dividing an annular core, the annular core being annularly shaped about a core axis, wherein, in a state where a plurality of divided end parts of the divided core parts are respectively covered with cup-shaped metallic bodies, the cup-shaped metallic bodies made of non-magnetic metal are sandwiched by the plurality of divided core parts, the annular metallic bodies each being annularly shaped about a respective body axis; and input windings provided in outer circumferential parts or inner circumferential parts of the cup-shaped metallic bodies to inductively heat the cup-shaped metallic bodies by application of an AC voltage, wherein the annular metallic bodies are positioned such that each body axis is perpendicular to the core axis.

11. The cup-shaped metallic body induction heating apparatus according to claim 10, wherein:

the annular core is configured to be a cut core type wound core.

12. The cup-shaped metallic body induction heating apparatus according to claim 11, wherein:

the annular core is divided into a first divided core part and a second divided core part that comprise a cut core; and in a state where a plurality of divided end parts in at least one of the first divided core part and the second divided core part are covered with the cup-shaped metallic bodies, the cup-shaped metallic bodies are sandwiched by the first divided core part and the second divided core part.

13. The cup-shaped metallic body induction heating apparatus according to claim 10, wherein:

the annular core is configured to include a plurality of leg cores, a first yoke core connected to one end parts of the plurality of leg cores, and a second yoke core connected to the other end parts of the plurality of leg cores; and each of the plurality of leg cores is formed in a cylindrical shape that is formed by radially stacking a number of magnetic steel sheets each having a curved part curved into an involute shape.

14. The cup-shaped metallic body induction heating apparatus according to claim 13, wherein:

the annular core is divided into a first divided core part including the plurality of leg cores and the first yoke core and a second divided core part including the second yoke core; and in a state where other end parts of the plurality of leg cores are covered with the cup-shaped metallic bodies, the cup-shaped metallic bodies are sandwiched by the first divided core part and the second divided core part.

15. The cup-shaped metallic body induction heating apparatus according to claim 13, wherein:

cooling pipes are provided in close contact with inner circumferential surfaces of the plurality of leg cores, and a cooling medium is circulated in the cooling pipes to thereby cool the plurality of leg cores.

16. The cup-shaped metallic body induction heating apparatus according to claim 10, wherein:

two sets of the cup-shaped metallic bodies and the input windings are provided, and an input power source that applies the AC voltage to the input windings is a single-phase power source.

17. The cup-shaped metallic body induction heating apparatus according to claim 10, wherein:

three sets of the cup-shaped metallic bodies and the input windings are provided, and an input power source that applies the AC voltage to the input windings is a three-phase power source.

18. The cup-shaped metallic body induction heating apparatus according to claim 10, the apparatus comprising an attachment/detachment mechanism that moves at least one divided core part of the plurality of divided core parts between a sandwiching position where the cup-shaped metallic bodies are sandwiched by the plurality of divided core parts and a detachment position where the cup-shaped metallic bodies can be detached from the divided core parts.

* * * * *